US005948120A

United States Patent [19]

Sights et al.

[11] Patent Number: 5,948,120

[45] Date of Patent: Sep. 7, 1999

[54] PROCESS FOR PRODUCING A CONTROLLED RUMPLED EFFECT TO DENIM OR TWILL GARMENTS

[75] Inventors: James Barton Sights; Shane Smithhart, both of Henderson; Richard Gaines, Robards; Robin Jourdan, Henderson, all of Ky.

[73] Assignee: Sights Denim Systems, Inc., Henderson, Ky.

[21] Appl. No.: 09/185,062

[22] Filed: Nov. 3, 1998

[51] Int. Cl.[6] ..... D06M 23/14; D06M 101/06

[52] U.S. Cl. ..... 8/114.5; 8/114; 8/115; 8/189; 8/195; 8/117; 8/115.53; 427/393.2

[58] Field of Search ..... 8/114, 114.5, 115, 8/189, 192, 195, 117, 115.53, 491, 493; 68/200, 240; 427/393.2

[56] References Cited

U.S. PATENT DOCUMENTS

| | | | |
|---|---|---|---|
| 1,076,608 | 10/1913 | Schultz | 8/114.5 |
| 1,558,453 | 10/1925 | Barrett et al. | 8/117 |
| 2,709,638 | 5/1955 | Babiarz et al. | 8/117 |
| 2,980,489 | 4/1961 | Gulledge | 8/117 |
| 2,991,146 | 7/1961 | Babiarz | 8/117 |
| 4,191,793 | 3/1980 | Gibson et al. | 427/276 |
| 5,395,281 | 3/1995 | Tonello | 451/28 |
| 5,593,072 | 1/1997 | Hester et al. | 223/120 |

FOREIGN PATENT DOCUMENTS

| | | |
|---|---|---|
| 200881 | 7/1923 | United Kingdom . |
| 228655 | 2/1925 | United Kingdom . |
| 615314 | 1/1949 | United Kingdom . |

OTHER PUBLICATIONS

CAPLUS Abstract of JP 59–163,463, Asahi Chemical Industry Co., Ltd., Sep. 1984.

CAPLUS Abstract of JP 59–125,962, Asahi Chemical Industry Co., Ltd., Jul. 1984.

*Primary Examiner*—Yogendra Gupta
*Assistant Examiner*—Caroline D. Liott
*Attorney, Agent, or Firm*—John Lezdey & Assoc.

[57] ABSTRACT

A process for instilling cellulosic garments with a worn and rumpled appearance without the use of fabric degrading chemicals or device, said process including treating the garments with a casting composition and curing while the garments are positioned on a support means.

11 Claims, 2 Drawing Sheets

PROCESS FOR PRODUCING A CONTROLLED RUMPLED EFFECT TO DENIM OR TWILL GARMENTS

FIELD OF THE INVENTION

The invention relates to a process for treating cellulosic textiles, and more particularly, it relates to processes for producing a controlled durable wrinkled or rumpled effect to denim or twill fabric garments.

BACKGROUND OF THE INVENTION

It is a known fact that the manufacturers of casual-fashion clothing made of denim materials in order to follow the trend of the market, treat the articles of clothing so as to give them a worn-out aspect.

In order to give the article of clothing said worn-out aspect, a washing operation is performed during which the article of clothing is treated with proper enzymes or with pumice powder, thereby producing the discoloring of the cloth and the worn out aspect previously mentioned. Sometimes it is also required that said articles of clothing present a worn out aspect which is localized only over particular areas. This is obtained by concentrating in the concerned areas a particularly strong discoloring operation through supplementary treatments.

One of the known methods used to perform such treatment consists in a very energetic manual brushing of the areas of the article of clothing where the discoloring is to be concentrated, thereby obtaining what in the technical jargon of this industrial sector is called "sanded effect". The inconveniences of such method of operation are rather obvious, the most evident being the length of time required by this operation and the ensuing high labor costs. Moreover, since this process must be performed manually, and depends exclusively on the operator's skill, it does not guarantee any continuity or reproduction of the same quality in the finished product.

Another known method consists in performing manually a localized sanding process by blasting the article of clothing with a mixture of air and sand. This method presents the same inconveniences presented by the before-described method with the addition that is it also highly polluting both for the environment and for persons involved in the process, so that it requires suitably equipped spaces for it be carried out.

BRIEF DESCRIPTION OF THE PRIOR ART

It is well known that the preparation of denim fabrics from cotton fibers or blends of cotton with other natural or synthetic fibers involves weaving from warp yarns that have been dyed usually with indigo dye (CI Vat Blue 1) and weft yarns. The weft (crosswise or filling yarns) are typically undyed. The yarns are woven in such a way so as to place a high proportion of the dyed yarns on the face of the fabric. This is usually done by weaving the yarns using one of the twill weaves.

To satisfy current fashion trends of faded and worn denim in garments various commercial methods referred to as stonewashing are available to this end. However, to achieve this stonewashed effect some of the decolorization or fading methods cause substantial deterioration or degradation of the fabrics. Abrading and chemical bleaching treatments or a combination of both methods damages the fabrics and ultimately reduces the wear life of the garments. In an attempt to improve the decoloration or fading of fibers, an ozone oxidation technique was developed. Ozone has been known to be used for bleaching of cellulose material without damaging the fibers as evidenced by U.S. Pat. Nos. 5,118,322, 5,261,925, 5,313,811 and 5,342,415, all of which are incorporated by reference.

Despite the above advance in the decolorization ozone processes, the processes alone fail to provide a permanent or durable wrinkled and rumpled look. Thus, it would be desirable to provide a fabric or garment which has a worn and rumpled look without reducing the wear life of the fabric or garment.

U.S. Pat. No. 4,191,793 to Gibson et al, which is herein incorporated by reference, discloses a process for producing durable creases along the length of a trouser leg. However, the appearance becomes that of a well-pressed garment rather than the rumpled and worn appearance.

U.S. Pat. No. 5,395,281 to Tonello, which is incorporated herein by reference, discloses an apparatus with a supporting mannequin which is used in an abrasion process to garments to give them a worn-out appearance. The abrasion results in degradation of the fabric with weak spots.

SUMMARY OF THE INVENTION

In accordance with the invention, there is provided a process for treating garments having cellulosic fibers to provide a controlled permanent or durable rumpled effect which comprises the steps of:

a) positioning the garment on a suitable support means;

b) providing a plurality of rumples into a desired form on the garment positioned on the support means;

c) applying an effective amount of a casting composition to the garment to yield durable rumples upon curing;

d) curing the casting composition so as to set the rumples in said garment; and then e) removing the garment from the suitable support means.

The support means may be a mannequin either as an integral body form or a part thereof such as legs, arms, torso, inter alia. The mannequins and parts thereof can be performed in a fixed position or can be articulated to a desired position, e.g. a bended knee, elbow, etc. The mannequins can be made from a material such as a light metal, a plastic, or rubber. The form refers to shape of each individual rumple. The pattern relates to a plurality of these individual rumples. In one embodiment, for ease of operation, the mannequins may be expansible. The desired rumpling effects are shaped either manually, mechanically or by air pressure which may be supplied internally or externally. The desired areas may include the knees and elbows of the mannequins.

The casting compound can be a natural or synthetic material, which depending on the resin/catalyst system used, upon curing conditions and proportions of resin/catalyst provides a durable rumple effect which may have properties ranging from a flexible rubbery feel to a hard inflexible set. Generally, any composition used to impart a permanent press to a textile can be utilized. The casting compound may be applied either by spraying, brushing, mopping or dipping.

The curing step can involve exposing the treated garment to thermal, or free-radical reactions or ultraviolet radiation or combinations of these processes. Typically thermal curing temperatures range from room temperature to temperatures of about 325° F. depending on the casting composition system are required. The curing step involves chemical bond cross-linking and yields irreversible durable rumples in the treated garment. A casting composition system comprising dimethylol dihydroxy ethylene urea catalyzed by magnesium chloride is a preferred system used in the practice of this invention. The curing of this system is conducted in an oven to maintain the fabric temperature from about 275° F. to about 325° F. and preferably about 300° F.

The process of this invention can be utilized with garments which have been subjected to various pre-treatments or post-treatments such as abrading, bleaching, decoloration, desizing and combinations of these operations to produce a garment having the appearance of being "stone washed" or "acid washed".

It is, therefore, a primary object of this invention to provide a process of forming a desirable pattern of rumples in a textile article which is durably preserved.

Another object of the invention is to provide a more efficient and economical process of treating a garment meeting the current fashion requirements of a worn look.

Yet another object of the invention is to selectively shape rumples in specific areas of a textile article to provide the worn look in fashion garments.

A further object is to provide the rumpled effect to a textile article which has undergone or will undergo various additional treatments such as abrading, bleaching, decoloring, desizing or combinations of these operations.

Other objects and a fuller understanding of the will be had by referred to the following description and claims of a preferred embodiment taken in conjunction with the accompanying drawings.

DETAILED DESCRIPTION OF THE PREFERRED EMBODIMENTS

Figure 1:
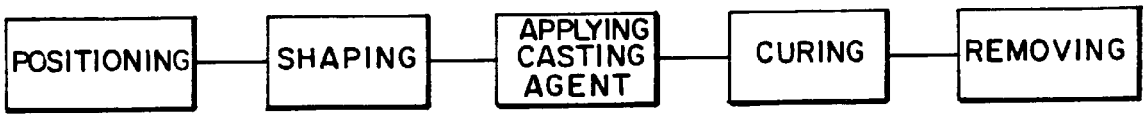
FIG. 1 shows a schematic view of a block diagram of one embodiment of the process of this invention.
Figure 2:
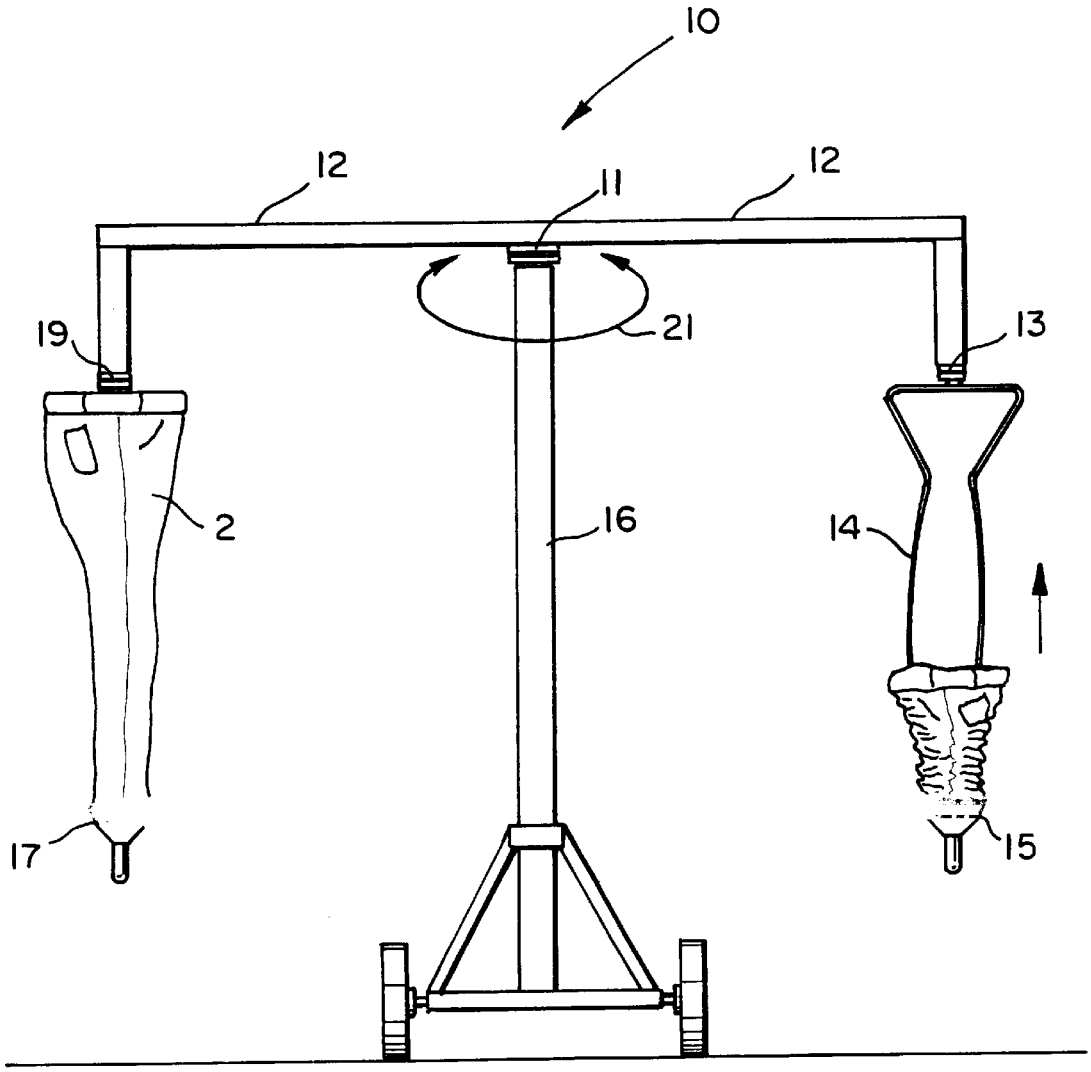
FIG. 2 is a schematic view of articles of clothing to be treated before being fitted on a mannequin and then fitted according to one embodiment of the present invention.
Figure 3:
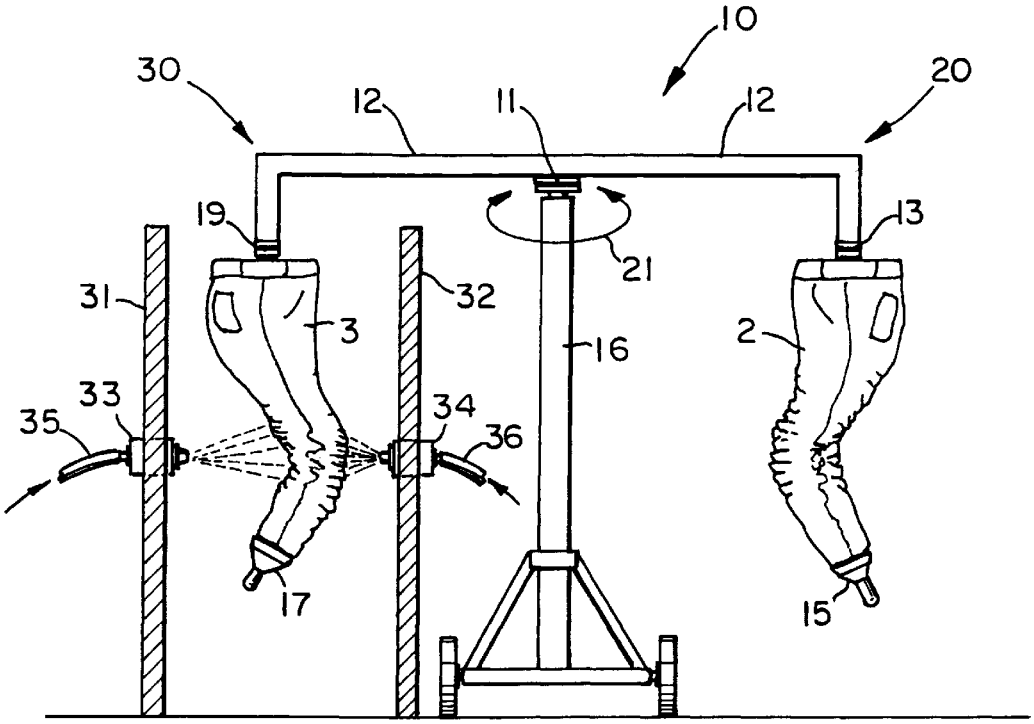
FIG. 3 is a schematic view of the garments to be treated shaped on the machine having the desired form and pattern of rumples and then undergoing a spraying application of the casting composition.
Figure 4:
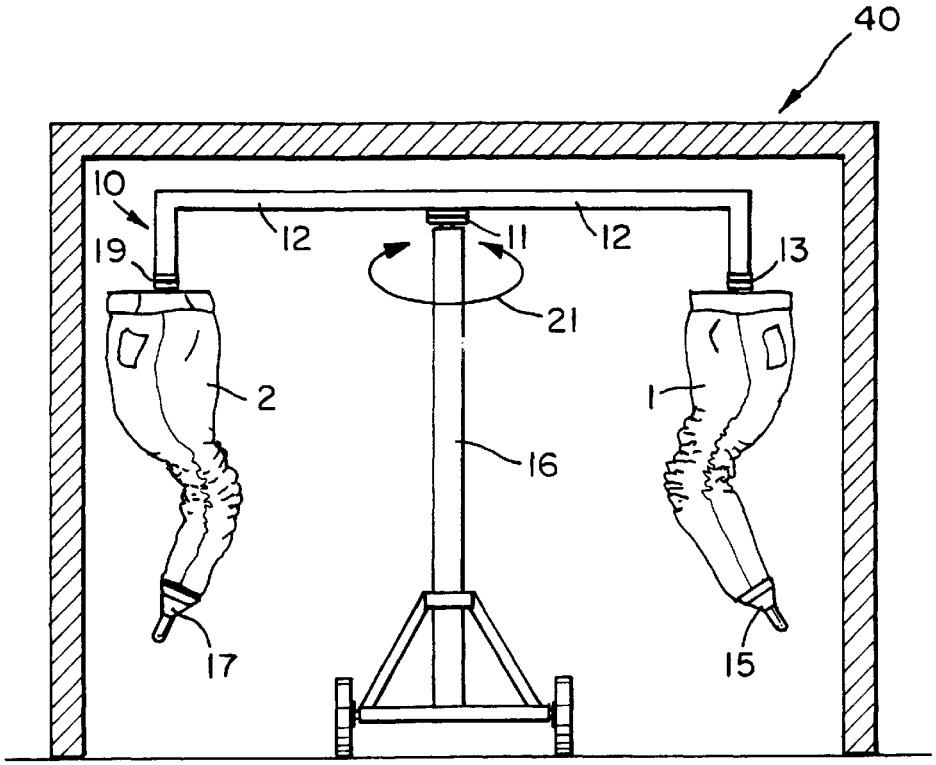
FIG. 4 shows the garments in the desired form and pattern rumples in the curing oven.

In accordance with a simplified version of this invention, FIG. 1 shows a flow diagram illustrating one embodiment of the instant invention in sequential steps for treating an article of clothing. FIGS. 2 through 4 further illustrate the various process steps shown in FIG. 1 in conjunction with a suitable apparatus 10. The apparatus 10 is a supporting and moving structure which comprises a vertical upright support 16 resting on a floor, its upper end being connected to a pivot means 11 in the middle of a rotatable traversal beam 12 from which workpiece support means 14 and 18 are arranged at each end of the beam 12. Workpiece support means 14 and 18 provide the articles of clothing, jeans 1 and 2 sufficient working support to undergo the treatment according to the present invention. Support means comprises typically a mannequin. The term "mannequin" includes a full body facsimile of a human form, as well as, a partial mannequin such as torso, arms, legs inter alia.

The mannequin can be made of a material such as a malleable metal, plastic, fiberglass or rubber which may be a preformed fixed support or a support which can be adjusted and articulated to provide a wide range of orientation to the workpiece. This allows for a wide latitude in the distribution of the durable rumples. Preferably, the support means is in the form of a tube to reduce the weight of the support structure 10. This weight reduction allows the beam 12 to be easily rotated manually in either direction as indicated by arrow 21 to provide a faster and easier access to the textile workpieces, jeans 1 and 2. The mannequins 14 and 18 can also be rotated by pivot means 13 and 19. This allows for the article of clothing to be easily manipulated.

The process of the present invention begins when the article to be treated in this embodiment, a pair of jeans 1, is positioned on mannequin 14 as illustrated in FIG. 2 until it is fitted as shown by jeans 2. FIG. 3 shows a manipulative phase of the instant process, i.e., the knees of the jeans in a bent position which allows for the desired pattern of formed rumples to be positioned in rumples to be shaped in specific areas. The beam 12 of the structure 10 is rotatable around pivot 11 and the garment referenced as jeans 2 is positioned in spraying area 30 located between walls 31 and 32 containing fluid dispensing means 33 and 36. The fluid dispensing means 33,36 illustrated are spray dispensers supplied with a casting composition through lines 35 and 36 connected to a reservoir tank (not shown). An effective amount of composition is applied to the pre-shaped areas which as shown in FIG. 3 involves the front and back of the jeans.

The next step in the process involves moving structure 10 into a heating means such as oven 40 as shown in FIG. 4 which is maintained at curing temperatures to crosslink the pre-set rumples. After curing, the jeans 1 and 2, are then moved from the oven, cooled and removed from the mannequin. The process can repeatedly continue without interruption. In lieu of heating means, a source of ultraviolet radiation may be employed if the casting solution can be cured by irradiation.

It is pointed out that the present description which is directed to a pair of mannequins, is given by way of illustration only, since there can be only one or a plurality of mannequins. Also on the basis of the present disclosure, it can be understood that the objects of the present invention have been achieved. The process is efficient in reducing the time necessary for manual operations. The manual setups of fitting, shaping and removal of the article of clothing from the mannequins can be performed while other garments are undergoing the application of the casting composition and the curing step. Therefore, optimum use of manpower and equipment is achieved.

The casting compounds are selected from natural or synthetic materials which may provide a cured material which may range from a flexible and rubbery effect or a hard, smooth effect each of which cured compositions are insoluble in water or dry-cleaning solvents. Any conventional composition or chemical system which imparts a "permanent or durable press" to a textile article could be utilized in this invention. Suitable casting compounds may include synthetic resins such as silicones, thiols, urethanes, and ureas. The preferred casting compound system is based on a dimethylol dihydroxy ethylene urea resin catalyzed by a magnesium chloride.

The curing conditions may vary depending on the composition of the casting compounds. For example, the silicone compositions cure at room temperature and the urea resins require fabric temperatures of from about 275° to 325° F. Some casting composition systems may be curable with free-radical or ultraviolet catalysis.

In one preferred embodiment, a casting composition is prepared comprising a 15 weight percent of an aqueous solution of a dimethyl dihydroxy ethylene urea catalyzed by magnesium chloride having a pH ranging from 3.5 to 4.5. Beginning from the step of shaping the rumples as shown in FIG. 2, a pair of shaped jeans are dipped into the casting bath (not shown) until an 85 percent moisture pick-up is attained, generally from about 6 to 8 minutes. After the treatment operations have been completed on a pair of jeans 1 another rotation of the supporting and moving structure 10 carries the other pair of jeans 2 into the bath for the same pick-up of casting compound. When both articles of clothing have been treated, structure 10 is moved into oven 30 for curing in the manner described above and illustrated in FIG. 4. After curing, the garments are cooled, removed and prepared for shipment. Thus, the device enables very quick handling of each article of clothing on equipment having a very low capital cost.

The textile article of clothing which can be durably rumpled may be in the form of garments, e.g., pleated skirts, trousers, jeans, jackets, inter alia. The garments may be made of any cellulosic fiber or blend of fibers, natural or synthetic, but it is envisaged that the process will be principally applicable to cellulosic fibers especially cotton. The fabric or garment construction may be woven, knitted or non-woven.

In operation of the invention, a garment such as a denim jacket or jeans is positioned on a support. The garment is then adjusted or shaped so that a desired rumple is placed onto the garment at the desired areas. The rumpled garment is then treated with a casting solution with a sufficient amount of solution so as to result in durable rumples or wrinkles when cured. The garments are then passed into a curing zone which can be a heating area such as an oven or source of ultraviolet radiation. After curing, the garment is removed and can be further treated if desired. The entire process can be stepwise or continuous.

The garments which are treated according to the invention can be those which have already been subjected to desizing and decoloration such as with the use of bleaching agents. Also, treatment with the casting agent, the garments can undergo abrasion or other garment treatment operations.

All the mentioned possible variations and modifications must, however, be considered as falling within the spirit and scope protected by the present invention.

What is claimed is:

1. A process for treating garments having cellulosic fibers to provide a garment having a controlled durable rumpled effect which comprises the steps of:

a) positioning said garment on a support means;

b) shaping a plurality of rumples in a desired form and pattern onto said garment positioned on the support means;

c) applying an effective amount of a casting composition to said garment to yield durable rumples upon curing;

d) curing said casting composition so as to set the rumples in the garment; and then e) removing said cured garment from said suitable support means.

2. The process of claim 1 wherein said support means is selected from frames, mannequins, or tubes.

3. The process of claim 1 wherein said support means are adjustable and articulated.

4. The process of claim 2 wherein said mannequins are expansible.

5. The process of claim 1 wherein a rumpled effect is provided throughout said garment.

6. The process of claim 1 wherein a rumpled effect is provided at the knees or elbows of said garment.

7. The process of claim 1 wherein said casting composition is a resin selected from silicones, thiols, urethanes or urea.

8. The process of claim 6 wherein the casting composition comprises a resin-catalyst system comprising dimethylol dihydroxy ethylene urea-magnesium chloride.

9. The process of claim 8 wherein said casting composition applied to said garment is thermally cured.

10. The process of claim 9 wherein during curing, said garment is maintained at temperatures from about 275° to about 325° F.

11. The process of claim 1 wherein said casting composition is curable by ultraviolet radiation.

* * * * *